United States Patent [19]

Shores

[11] Patent Number: 4,753,169

[45] Date of Patent: Jun. 28, 1988

[54] ABLATING ELECTROMAGNETIC SHIELD SHEATH

[75] Inventor: Marvin W. Shores, Pomona, Calif.

[73] Assignee: General Dynamics, Pomona Division, Pomona, Calif.

[21] Appl. No.: 812,597

[22] Filed: Dec. 23, 1985

[51] Int. Cl.[4] ..... F42C 19/04

[52] U.S. Cl. ..... 102/293; 102/378

[58] Field of Search ..... 102/378, 214, 293

[56] References Cited

U.S. PATENT DOCUMENTS

| | | | |
|---|---|---|---|
| 2,655,106 | 10/1953 | O'Brien | 102/70 |
| 2,782,716 | 2/1957 | Johnston | 102/378 |
| 2,998,943 | 9/1961 | Dobbins et al. | 244/14 |
| 3,070,014 | 12/1962 | Gose | 102/49 |
| 3,098,632 | 7/1963 | Christenson | 224/135 |
| 3,112,903 | 12/1963 | Conrad | 224/54 |
| 3,118,638 | 1/1964 | Rohr | 244/14 |
| 3,198,073 | 8/1965 | Van Tine et al. | 89/1.7 |
| 3,357,356 | 12/1967 | Bischoff | 102/49.5 |
| 3,453,960 | 7/1969 | Qualls | 102/378 |
| 3,637,166 | 1/1972 | Nicholson et al. | 244/1 R |
| 3,674,227 | 7/1972 | Jacobson et al. | 102/293 |
| 3,730,098 | 5/1973 | Edwards | 102/34.4 |
| 3,901,028 | 8/1975 | Leingang | 60/225 |
| 3,971,024 | 7/1976 | Clark, Jr. et al. | 343/872 |
| 4,323,012 | 4/1982 | Driver, Jr. | 102/378 |
| 4,593,637 | 6/1986 | Klee | 102/293 |

*Primary Examiner*—Charles T. Jordan

*Attorney, Agent, or Firm*—Neil F. Martin; Edward B. Johnson

[57] ABSTRACT

An attachable, ablating shield comprises a metalized sheath for fitting closely over, for covering, and for protecting an electronics section in a missile from external electromagnetic radiation, particularly from high-energy radio frequency radiation, during launch. The sheath has weakened seams so that the sheath will separate from the missile when a seam is split. The sheath splitting system comprises an explosive device located near a seam, a detector for sensing the firing of the rocket motor, and a transfer line therebetween for receiving a motor-fire signal from the detector and for transferring a corresponding signal to the explosive device to split the sheath. A preferred embodiment employs a low-explosive and a transfer line that is a high-intensity shock pulse tube. The transfer line ablates with the sheath.

11 Claims, 1 Drawing Sheet

ABLATING ELECTROMAGNETIC SHIELD SHEATH

BACKGROUND OF THE INVENTION

1. Field of the Invention

This invention relates in general to a shield for protecting electronic instruments sensitive to electromagnetic energy and more particularly to an ablating shield for attachment to a missile.

2. Background of the Invention

Missiles, particularly ship-launched missiles, are exposed to high levels of electromagnetic radiation while on the launcher and in the proximity of the ship during launch. The radiation levels are particularly high if spotlighted by the main beam of radar. Electronic components in missiles have been found to be adversely affected by high levels of electromagnetic radiation which can cause serious performance degradation by digital upset, bias shut-off or possibly burn up. The energy is coupled by the missile body and by internal circuitry via apertures on the surface of the body. The apertures may be nonfunctional openings in the body surface that expose internal wiring to direct radiation as well as allowing the skin current induced on the outer surfaces to flow inside, or the apertures may be intentional, namely antennas.

Conventionally, circuit components associated with antenna output have been protected by series attenuators that are automatically switched out when the distance from the radiation source causes the radiation received to drop to acceptable levels. Such attenuators are very costly.

Therefore, it is desirable to have a shield for protecting electronic components of a missile while in the proximity of ship and for ablating shortly after launch to allow proper functioning of the electronics.

It is further desirable that such a shield requires no internal modification to the missile. It is further desirable that such a shield is easily attachable to a missile.

It is further desirable that such a shield be relatively insensitive to electrostatic discharges such as generated by personnel and to physical shocks of handling and storage.

SUMMARY OF THE INVENTION

This invention is an ablating electromagnetic shield sheath for use on a missile. The sheath protects the electronics portion of a missile from exposure to very high levels of electromagnetic radiation while on the launcher and in the proximity of a ship or other launching means.

Broadly speaking, the invention comprises a sheath of metallic material for fitting closely over, for covering, and for protecting an electronics section in a nose portion of a missile from external electromagnetic radiation and means for splitting the sheath at the proper time after launch to ablate the shield. Preferably the sheath is electrically bonded to a missile casing. The sheath contains weakened paths or seams such that splitting of a seam along its entire length will cause the sheath to separate from the missile.

The sheath is intended to protect the sensitive electrical components in a missile from physical damage during storage and launch and from high-energy electromagnetic energy damage, particularly in the radio frequency range, during travel, storage, and launch. The sheath ablates at a predetermined time after launch.

The system for splitting the sheath consists generally of an explosive device, a detector, and a transfer line therebetween. In the exemplary embodiment, the detector is located to detect the firing of the missile motor and outputting a signal after a predetermined period of time. The transfer line receives the motor signal and signals the explosive device to detonate. Upon detonation, the explosive device splits at least part of a sheath seam and ram air separates the sheath from the missile.

In a preferred embodiment the transfer line is a high-intensity shock pulse tube which will ablate with the sheath.

Other featuers and many attendant advantages of the invention will become more apparent upon a reading of the following detailed description together with the drawings, wherein like reference numerals refer to like parts throughout.

DETAILED DESCRIPTION OF THE INVENTION

Figure 1:
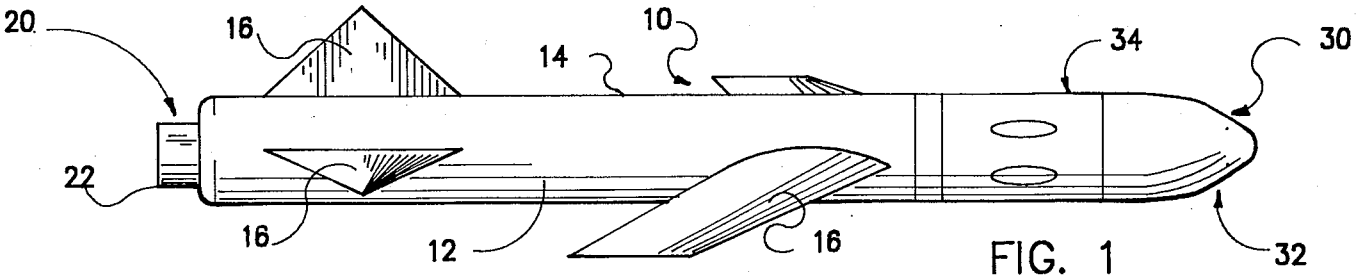
FIG. 1 is a perspective view of a typical missile having electronic components in the nose portion.

With reference now to the drawing, and more particularly to FIG. 1 thereof, there is shown a typical missile, shown generally as 10. Missile 10, shown, is of the type commonly launched from a ship because ship-launched missiles are commonly exposed to very high levels of electromagnetic radiation energy while on the launcher and in the proximity of the ship during launch, particularly if spotted by the main beam of radar. Therefore, this type of missile is particularly suitable for attachment of the electromagnetic shield sheath of the present invention. However, the sheath may be used with many different missile types and configurations.

Missile 10 has a generally elongated body 12 having a nose end 30 and an aft end 20. Body 12 typically has an external airframe casing 14 and flight surfaces 16. The missile 10 contains a rocket motor for propelling the missile. The motor thrust gasses exit the missile at rocket motor exhaust port 22 in the aft end 20.

Typically, the nose portion of a missile contain an electronics portion 32 which contains the various electronic components required for navigation or for target recognition and seeking. System antennas 34 are used to help perform these functions.

Figure 2:
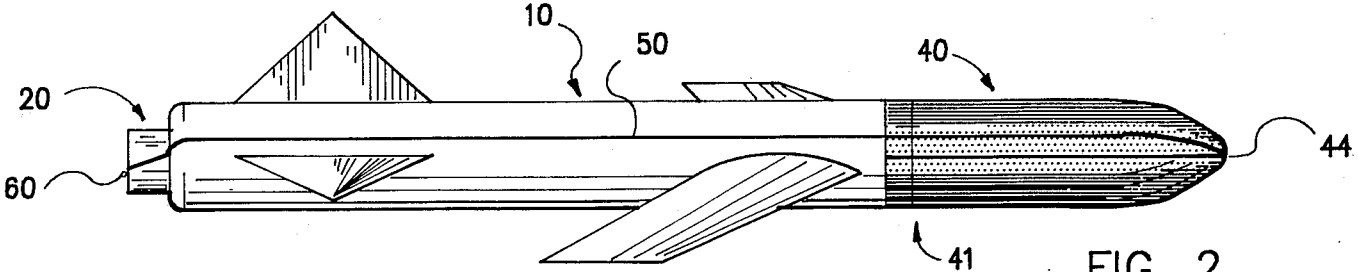
FIG. 2 is a perspective view of the missile of FIG. 1 shown with the ablating electromagnetic shield of the present invention attached thereto.

With reference now to FIG. 2, there is shown the ablating electromagnetic shield of the present invention as it would be used attached to a typical missile 10. The shield generally comprises a sheath 40, and means for splitting the sheath at the proper time. Sheath 40 is made of material which is generally impervious to electromagnetic radiation and would commonly be fabricated from a metalized material. The form-fitting sheath 40 is designed to fit closely over and cover the electronics portion 32. The shield includes means, such as bonded area 41, for making electrical contact between the aft end of sheath 40 and missile casing 14. This bonded area 41 preferably includes a continuous circumferential electrical contact between the aft end of the sheath and the missile casing 14. This may be accomplished by use of low-strength, conductive bonding material. Once grounded, the sheath 40 acts as a continuous ground plane to prevent harmful electromagnetic radiation from reaching sensitive electronics in the electronics portion.

Once the sheath 40 is mounted on a missile in this manner, it not only protects the sensitive electronic elements from harmful electromagnetic radiation pulses, particularly radio frequency pulses, but it also serves as a mechanical shield and thereby also protects the delicate surfaces, such as antennas, on the missile from damage, scratches, and contamination prior to launch.

Sheath 40 contains weakened paths or seams 42. The seams 42 are so disposed that a splitting of a seam along its entire length will cause the sheath to separate from the missile. In the exemplary embodiment of FIG. 2, a single seam 42 traverses sheath 40 so that upon splitting of the seam, the sheath is divided into upper and lower sections which fall away from the missile.

Figure 3:
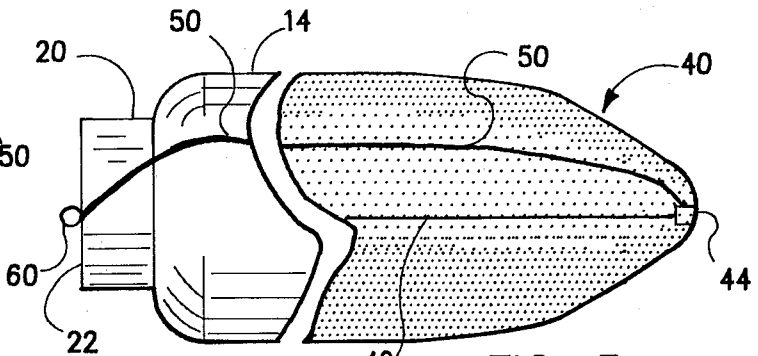
FIG. 3 is an enlarged side elevation view of the nose and aft portions of the missile of FIG. 2 showing the sheath splitting apparatus in greater detail.

A system for splitting the sheath 40 along the weakened seam 42 at a predetermined time consists generally of a sheath splitting means, such as explosive device 44, detector 60 and transfer line 50. These elements are shown in greater detail in FIGS. 3, 4 and 5. The explosive device 44 is located near a seam so that upon detonation it will split the seam along at least a part of its length. Preferably, the explosive device 44 is a low-level explosive which, if placed at the tip of the sheath 40, will upon detonation simply open the tip of the sheath. Explosive device 44 is insensitive to electrostatic discharges of the type generated by personnel and is therefore safe to handle. The explosive device 44 may be compared of ITLX, a federally registered trademark, manufactured by Explosive Technology, a subsidiary of OEA, Inc., Fairfield, Calif.

Figure 4:
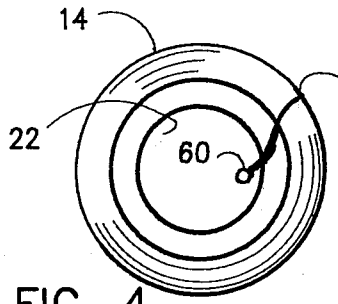
FIG. 4 is an aft view of the missile of FIG. 3.
Figure 5:
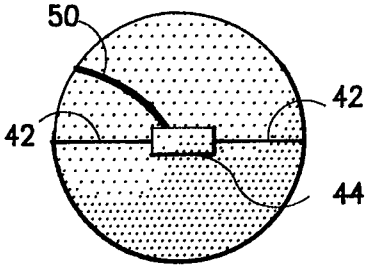
FIG. 5 is a front view of the missile of FIG. 3 showing the transfer line and explosive device on the ablating shield.

As shown in FIG. 4, a detector 60 is located so as to detect the firing of the missile motor. In this example, it is located adjacent the rocket motor exhaust port 22 at the aft end 20 of the missile. The detector 60 detects the firing of the rocket motor and outputs a motor signal in response thereto. Transfer line 50 connects the detector 60 with the explosive device 44 and receives the motor signal from the motor detector 60 and transfers a corresponding signal to the explosive device 44 signaling it to detonate. In a preferred embodiment, the transfer line is a high-intensity shock pulse tube such as that manufactured by Explosive Technology of Fairfield, Calif. under the trademark "TLX". The transfer line 50 is a simple plastic tube of approximately 3 millimeter diameter. The tube has a coating of reactive material on the inside surface that sustains a shock pulse from one end of the tube to the other. Function of the transfer line 50 produces no external effects along its length except a bright flash of light. The transfer line 50 can be initiated by a brisant primer, e.g. M79, a bare exploding bridge wire (EBW), an electric blasting cap (EBC) or with standard end fittings such as any common transfer component such as Shielded Mild Detonating Cord (SMDC) or Flexible Confined Detonating Cord (FCDC). The output of the transfer line is a 4000 pounds per square inch shock pulse peaking at 25 microseconds. This pulse is strong enough to detonate the explosive device 44. The TLX transfer line 50 can only be initiated by a strong shock force such as indicated above and cannot be initiated by ordinary shock forces or static discharge.

The shield functions in use as follows. The rocket motor ignites and launch commences. The rocket motor detector and initiator 60 is heated by the motor exhaust. After a prescribed period of time the initiator ignites. The time is based on the ship-to-missile separation necessary to reduce the intensity of the shipboard electromagnetic environment below the threshold of damage and interference. The time period may vary with various missiles and environments. The detector and initiator end-initiates the transfer line and a high-intensity shock pulse passes through the time to the explosive device 44 thereby detonating it. The explosive device detonates to simply open the tip of the sheath 40. The open sheath tip catches ram air and the sheath commences to split along the purposely weakened seam 42 until the sheath parts and detaches completely from the missile.

It is important to note that one or more of the sheath splitting components may be added to the missile at any time. Also, it should be noted that, because of its external nature, this system is easily adaptable to any missile.

The transfer line and/or the detector may be attached to the missile casing 14 in such a manner, possibly by tape, that allows it to rip off clear of the missile along with the expended sheath. Thus, it can be seen that the ablating shield seals off both antennas and functional apertures, thus protecting mixer diodes and protecting radio frequency leakage through unsealed holes from circumventing the internal functions and creating malfunction. Additionally, the shield eliminates the need for costly switch-out attenuators.

From the foregoing description, it is seen that the present invention provides an extremely simple, efficient, and reliable manner of protecting missile electronics from harmful electromagnetic radiation during launch.

Although a particular embodiment of the invention has been illustrated and described, modifications and changes will become apparent to those skilled in the art, and it is intended to cover in the appended claims such modifications and changes as come within the true spirit and scope of the invention.

What I claim is:

1. An ablating electromagnetic shield for use in combination with a missile; the missile including a rocket motor and an elongated body having: an external casing; an aft end; and a fore nose portion containing an electronics section which is sensitive to external electromagnetic radiation; said shield comprising:

a sheath of material which is generally impervious to electromagnetic radiation for fitting closely over, for covering, and for protecting an electronics sections in a nose portion of a missile from external electromagnetic radiation; said sheath having:

a weakened seam so situated that a splitting of said seam along its entire length will cause said sheath to separate from a missile;

seam splitter means for splitting said weakened seam along at least a part of its length; and sheath splitter means for splitting said sheath along said weakened seam at a determined time; said means including:

motor detector means for detecting the firing of a rocket motor and for outputting a motor signal in response to detection of rocket motor firing; and transfer line means connected to said motor sensor means and to said seam splitter means for receiving said motor signal from said motor detector means and for transferring a corresponding signal to said seam splitter means.

2. The shield of claim 1 wherein said sheath is of metalized material.

3. The shield of claim 1 wherein said sheath further includes:

an aft end having means for making electrical contact with a missle casing.

4. The shield of claim 3 wherein said electrical contact means includes means for making continuous circumferential electrical contact between said aft end of said sheath and a missile casing.

5. The shield of claim 1 wherein said seam splitter means includes:

an explosive device located near said seam.

6. The shield of claim 5 wherein said explosive device is located near the fore-most part of said sheath.

7. The shield of claim 1 wherein said seam splitter means is located near the fore-most part of said sheath.

8. The shield of claim 1 wherein said motor detector means includes:

time delay means for delaying for a predetermined amount of time the output of a motor signal to said transfer line means.

9. An ablating electromagnetic shield for use in combination with a missile; the missile including a rocket motor and an elongated body having: an external casing; an aft end; and a fore nose portion containing an electronics section which is sensitive to external electromagnetic radiation; said shield comprising:

a sheath of material which is generally impervious to electromagnetic radiation for fitting closely over, for covering, and for protecting an electronic section in a nose portion of a missile from external electromagnetic radiation; said sheath having:

a weakened seam so situated that a splitting of said seam along its entire length will cause said sheath to separate from a missile;

electrical contact means for making continuous circumferential electrical contact between the aft end of said sheath and a missile casing; and sheath splitter means for splitting said sheath along said weakened seam at a predetermined time; said sheath splitter means including:

seam splitter means for splitting said weakened seam along at least part of its length; said seam splitter means including an explosive device;

motor detector means for detecting firing of a rocket motor and for outputting a motor signal in response to detection of rocket motor firing; and transfer line means connected to said motor detector means and to said seam splitter means for receiving said motor signal from said motor detector means and for transferring a corresponding signal to said seam splitter means; said transfer line means including ignitor means for detonating said explosive device.

10. The shield of claim 9 wherein said motor detector means includes:

time delay means for delaying for a predetermined amount of time the output of a motor signal to said transfer line means.

11. The shield of claim 9 wherein said transfer line is a high-intensity shock pulse tube.

* * * * *